US005381905A

United States Patent [19]

Mallmamm et al.

[11] Patent Number: 5,381,905

[45] Date of Patent: Jan. 17, 1995

[54] DISPOSABLE SUPPORT FOR PIZZA

[75] Inventors: Breno S. Mallmamm; Fábio Irigoite, both of Porto Alegre, Brazil

[73] Assignee: Grupoutil De. De Prod. De. Util. Ltda., Port Alegre, Brazil

[21] Appl. No.: 57,256

[22] Filed: May 4, 1993

[30] Foreign Application Priority Data

Sep. 22, 1992 [IT] Italy ..... PI9104128

[51] Int. Cl.[6] ..... A45G 11/20

[52] U.S. Cl. ..... 206/551; 206/45.32; 229/115; 229/906

[58] Field of Search ..... 206/551, 45.32; 229/115, 906

[56] References Cited

U.S. PATENT DOCUMENTS

| | | | |
|---|---|---|---|
| 3,283,889 | 11/1966 | Hetrick et al. | 206/551 X |
| 3,937,389 | 2/1976 | Wind | 206/551 X |
| 4,635,843 | 1/1987 | Tomlinson | 206/551 X |
| 4,836,593 | 6/1989 | Cooley | 206/551 X |
| 4,940,190 | 7/1990 | Groves | 206/551 X |
| 5,129,521 | 7/1992 | Irigoite et al. | 206/551 |

*Primary Examiner*—William I. Price

*Attorney, Agent, or Firm*—McGlew & Tuttle

[57] ABSTRACT

DISPOSABLE SUPPORT FOR PIZZA, made whether of a paper covered by a waterproof material or totally in plastic, having a base of a basically triangular or circular shape, characterized by comprissing a rear edge delimited by a circular sector-shape rear edge, and a folding line, which is symmetrical to said rear edge.

3 Claims, 3 Drawing Sheets

DISPOSABLE SUPPORT FOR PIZZA

FIELD OF THE INVENTION

This invention refers to an improvement introduced into disposable-type supports for tasting pizza in pieces and similar formats.

More specifically, this invention refers to a support, generally made whether of paper covered by waterproof material or totally in plastic, having a base in the same shape as the piece of pizza to be tasted and subsequently comprising a folding rear edge from a peculiar folding line, so as to involve the rear portion of the piece of pizza, thereby providing a safe and hygienic tasting of the same.

The particular arrangement of the rear edge folding line provides the side ends of the subsequent portion of the support base with the property of raising in relation to the base plane, which prevents liquid residues (sauce), eventually concentrated in said region to overflow.

SUMMARY AND OBJECTS OF THE INVENTION

The present invention, made whether of a paper covered by a waterproof material or totally in plastic, having a base of a basically triangular or circular shape, comprises a rear edge delimited by a circular sector-shape rear edge, and a folding line, which is symmetrical to the rear edge.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE INVENTION

Figure 1:
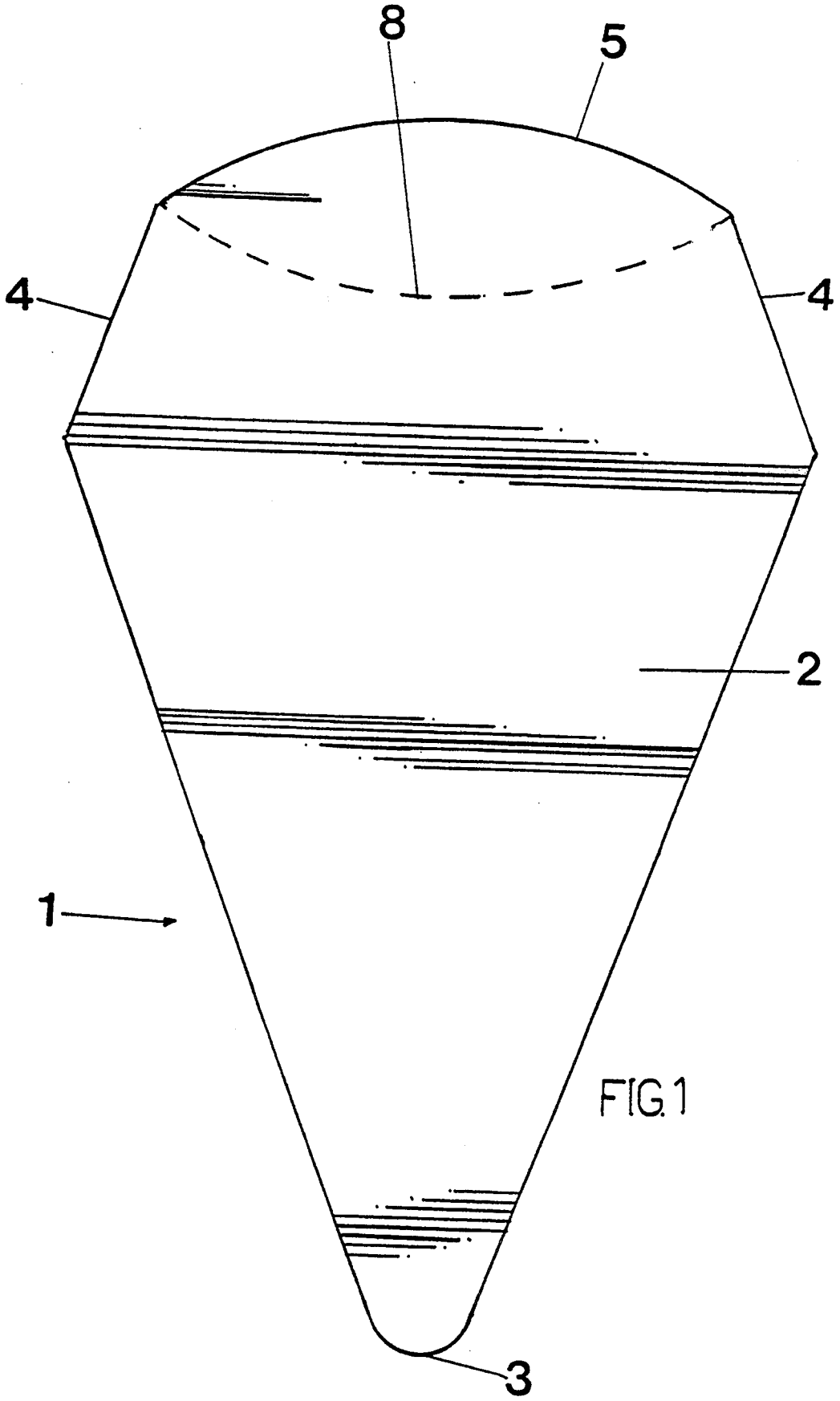
FIG. 1 is an upper elevation view of the object of the present invention is a first position.
Figure 2:
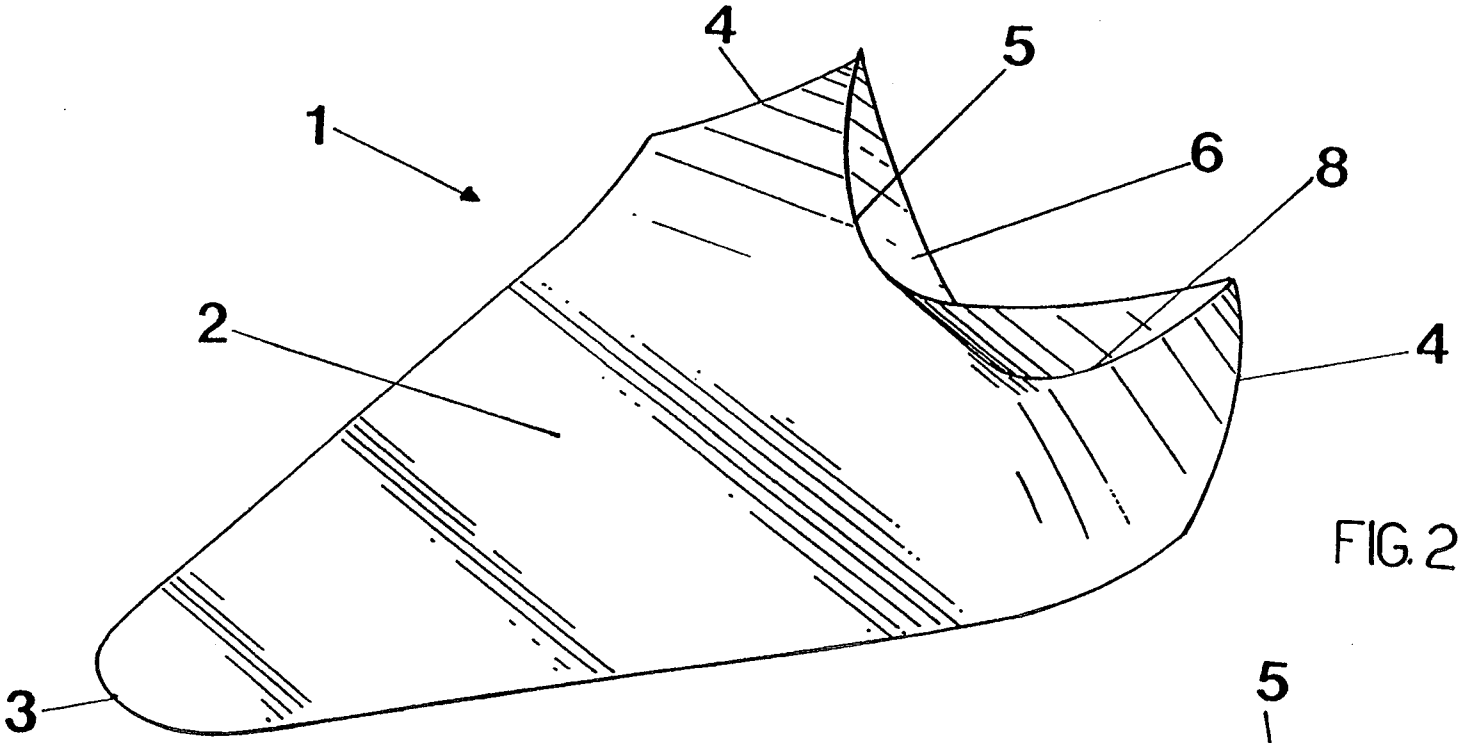
FIG. 2 is a perspective view of the support of FIG. 1 in a second position.
Figure 3:
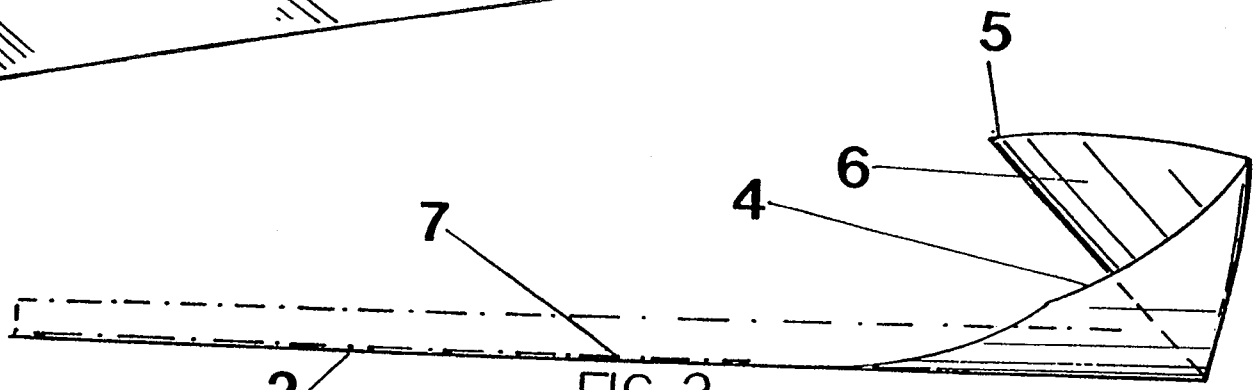
FIG. 3 is a side view of the support of FIG. 1.

In accordance with the illustration of the attached figures, in a particular way of realizing the present invention, it is generally indicated with the support 1 for pizza slices, which has a basically triangular base 2 and provided with a rounded front apex 3.

A rear portion of said base 2 presents a circular sector-shaped edge 5, adjacent to the side edges 4 of the rear portion of the base 2. In order to allow the folding of the rear edge 6 over the piece of the pizza 7 arranged over the base 2, a folding means including a folding line 8 symmetrical to the edge 5 is provided.

Thus, with the rear edge 6 folding over the base 2, and specifically as a result of the arrangement of the folding line 8, the side edges 4 of the base rear portion 2 raise in relation to the base plane 2, turning towards the inside of the support, thereby preventing that eventual liquid residues of the pizza may flow to the outside of support 1.

Figure 4:
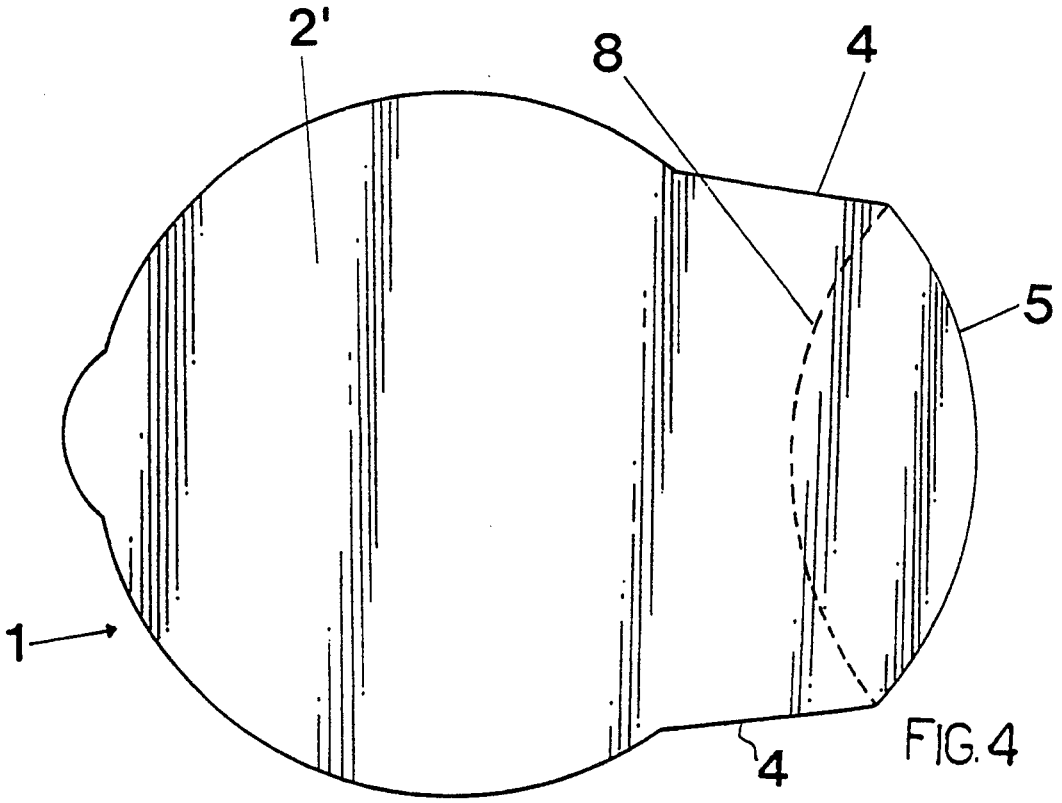
FIG. 4 in an upper elevation view of an alternative way of realizing the present invention.
Figure 5:
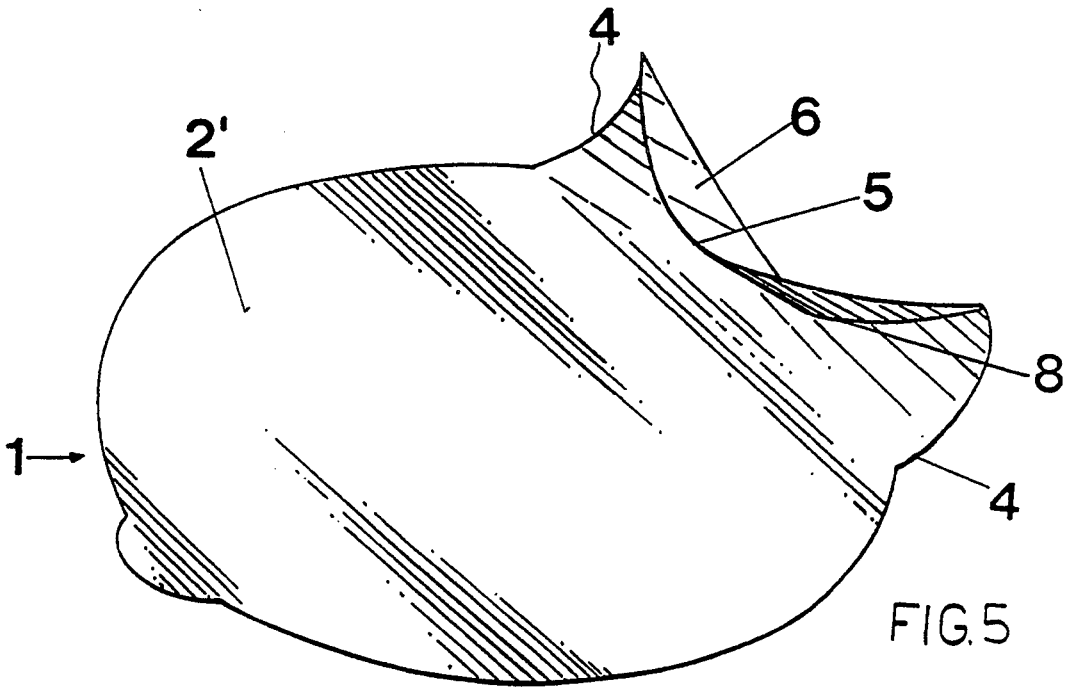
FIG. 5 is a perspective view of the support as illustrated by FIG. 4.

As an alternative way of realizing the present invention, as shown in FIGS. 4 and 5, support 1 exhibits the same characteristics as described, except by the base shape 2' which, in this case, has a circular shape in order to adapt to a particular type of pizza known as mini-pizza which, unlike the traditional types, is served in small circular disks.

While specific embodiments of the invention have been shown and described in detail to illustrate the application of the principles of the invention, it will be understood that the invention may be embodied otherwise without departing from such principles.

We claim:

1. A support for food, the support comprising:

a base portion having a shape substantially similar to the food to be supported, said base portion including first and second side edges and an inside portion;

a rear portion attached to said base portion between said first and second side edges;

folding means for movably attaching said rear portion to said base portion between a first position and a second position, said folding means causing said base portion and said rear portion to lie substantially flat in said first position, and said folding means causing movement of said rear portion into said second position to cause said base portion to curve with said first and second side edges rising and turning toward said inside portion of said base portion, said fold means includes a fold line positioned between said base portion and said rear portion, said fold line extending from said first side edge toward said second side edge and being curved with a middle part of said fold line extending toward said inside portion of said base portion.

2. A support in accordance with claim 1, wherein:

said rear portion has a rear edge extending from said first side edge toward said second side edge and being curved with a middle part of said rear edge extending away from said inside portion of said base portion, said rear edge and said fold line being substantially symmetrical.

3. A support in accordance with claim 1, wherein:

said rear portion and said base portion are formed of one of a plastic and a paper coated with a waterproof material;

said shape of said base portion is one of substantially triangular and circular.

* * * * *